US005186660A

United States Patent [19]

Wielgos et al.

[11] Patent Number: 5,186,660

[45] Date of Patent: Feb. 16, 1993

[54] BI-LEVEL WIRING HARNESS CONNECTOR

[75] Inventors: Thaddeus S. Wielgos, Des Plaines; Declan E. Killarney, Naperville; Katalin A. Schmidt, Des Plaines, all of Ill.

[73] Assignee: Eaton Corporation, Cleveland, Ohio

[21] Appl. No.: 433,815

[22] Filed: Nov. 9, 1989

[51] Int. Cl.[5] ..... H01R 21/00

[52] U.S. Cl. ..... 439/685; 439/678; 439/544

[58] Field of Search ..... 439/660, 676, 682, 683, 439/685, 544, 545, 552, 557, 558, 562, 567, 677, 678, 680

[56] References Cited

U.S. PATENT DOCUMENTS

| | | | |
|---|---|---|---|
| 1,967,021 | 7/1934 | Gary | 439/677 |
| 3,101,985 | 8/1963 | Skony | 439/685 |
| 3,701,082 | 10/1972 | Baumanis | 439/678 |
| 3,954,318 | 5/1976 | Larson et al. | 439/544 |
| 4,210,382 | 7/1980 | Culberton | 439/682 |
| 4,352,538 | 10/1982 | Fowler | 439/544 |
| 4,758,182 | 7/1988 | Anbo et al. | 439/592 |

*Primary Examiner*—Larry I. Schwartz
*Assistant Examiner*—Hien D. Vu
*Attorney, Agent, or Firm*—R. A. Johnston

[57] ABSTRACT

A bi-level electrical cable or harness connector for right angle connection through a bulkhead. The individual conductors are disposed in superposed layers or levels in a connector body and terminate at staggered locations along the connector. Access holes are provided for pin insertion at right angles to the conductors. One layer is accessed through holes provided in a well and the other layer accessed through holes in the connector surface.

12 Claims, 2 Drawing Sheets

BI-LEVEL WIRING HARNESS CONNECTOR

BACKGROUND OF THE INVENTION

The present invention relates to connectors for electrical cables having a plurality of individual conductors and particularly cables for automotive wiring harnesses having plural conductor cables which terminate at a bulkhead, panel or other partition. The invention relates more particularly to applications where it is desired to have the cable connector extend through the partition for releasable connection thereto on the opposite side thereof. Such bulkhead or panel connectors are often employed in automotive applications where it is desired to provide a multiple conductor cable connection across the bulkhead between the passenger compartment and the engine compartment. In such automotive applications, it has been found desirable, and in some cases necessary to employ right angle connectors on the engine compartment side of the bulkhead to minimize the intrusion of the connector and cable conductors into the engine compartment and to permit routing of the cable conductors along the bulkhead. In automotive applications where multiple conductors are attached to a single bulkhead connector, it has been desired to minimize the size of the aperture required to permit passage of the connector through the bulkhead and minimize the cross-section of the connector.

Where multiple electrical conductors or wires are bundled in a common cable or harness it has been found cumbersome to arrange the individual conductors in a common connector and minimize the cross-section of the connector yet provide for individual right angle connection to each conductor. Thus, it has been desired to find a way or means of providing a bulkhead connector for a multiple conductor cable and provide for the connector extending through a bulkhead and to provide a right angle connection to each of the individual conductors on the remote side of the bulkhead and to minimize the size of the connector for any given size and number of individual conductors.

SUMMARY OF THE INVENTION

The present invention provides a connector for a multiple conductor wiring cable or harness of the type that may be attached to a bulkhead or partition and extends therethrough for right angle attachment thereto on the remote side of the partition. The bulkhead connector of the present invention has the individual conductors in the cable or harness received in channels formed in the connector in superposed layers or levels with the conductors in adjacent levels terminating at staggered stations along the conductor. Individual terminals are attached to the end of each conductor and apertures are provided in the structure of the connector to permit insertion of connecting electrical terminals into the connector at generally right angles to the conductors in a bi-level arrangement.

The connector of the present invention has one layer or level of conductors disposed in channels adjacent the surface of the connector, and the second layer or level disposed in channels below the first layer and which communicate via apertures into a recess or well for receiving individual electrical connectors for each of the conductors in the second level. The cable connector of the present invention is thereby adapted for attachment thereto by a mating connector accessing the individual conductors at generally right angles thereto for providing convenience of attachment. The arrangement of the layers of individual conductors in the connector of the present invention permits the connector to extend through a bulkhead or partition and minimizes the cross-sectional area thereof for any given number of specified conductors in the cable, and yet provides for convenient right angle attachment thereto on the remote face of the partition.

DETAILED DESCRIPTION

Figure 1:
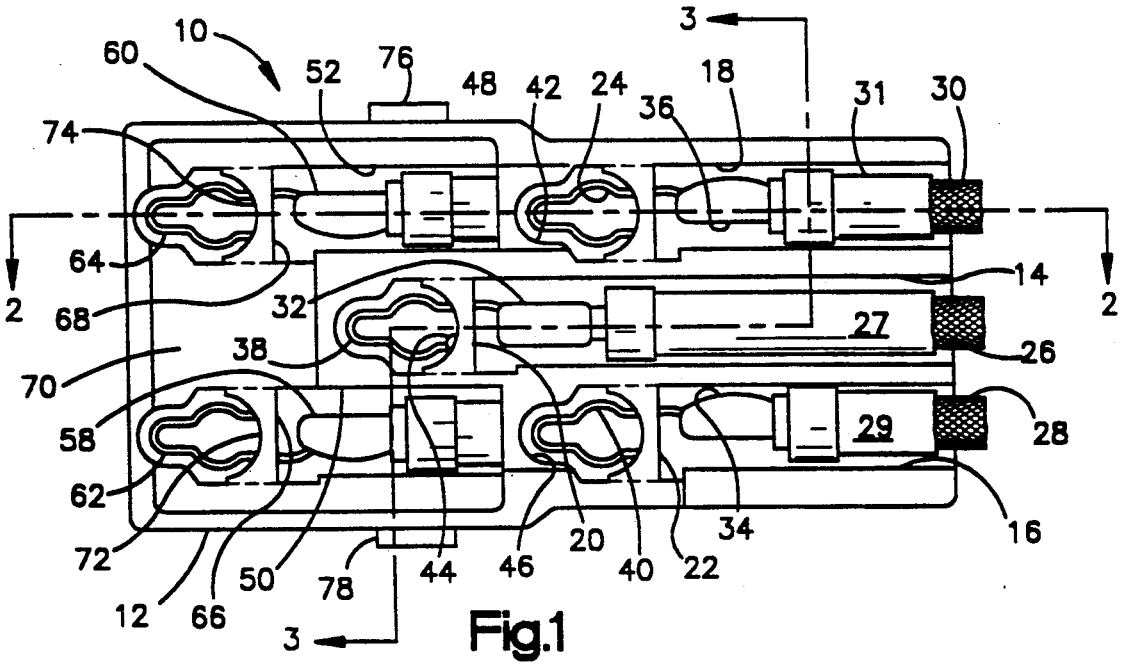
FIG. 1 is a plan view of the connector of the present invention from the direction of access for electrical attachment thereto.
Figure 2:
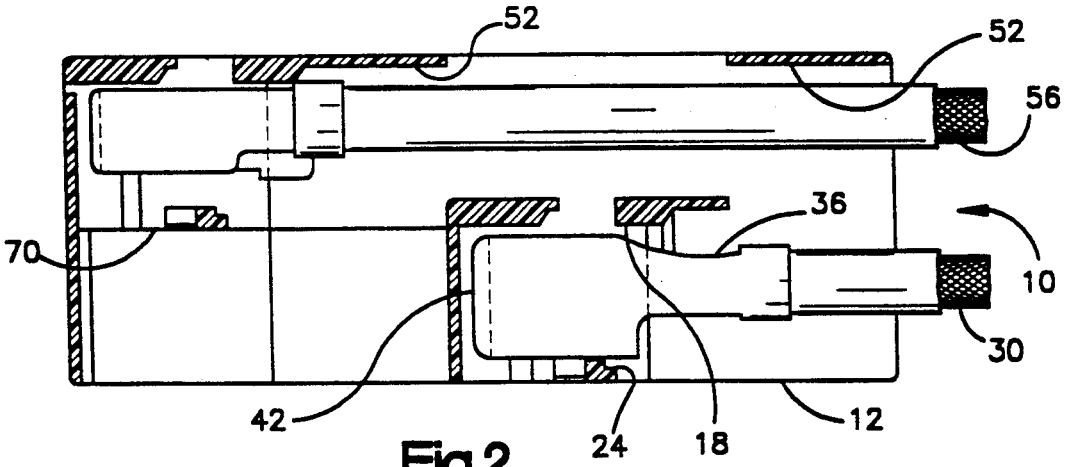
FIG. 2 is a section view taken along section indicating lines 2—2 of FIG. 1.
Figure 3:
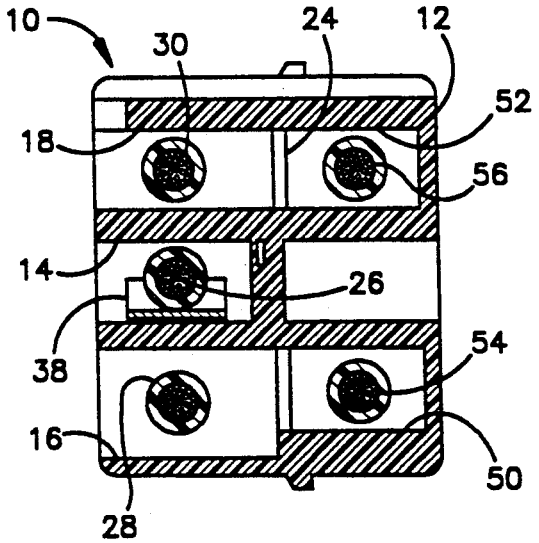
FIG. 3 is a section view taken along section indicating lines 3—3 of FIG. 1.
Figure 4:
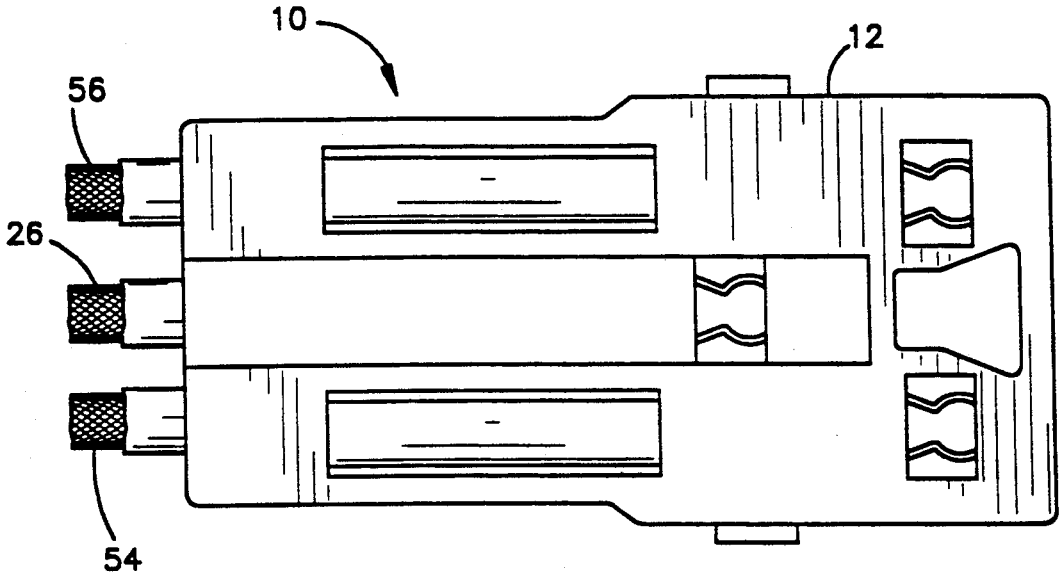
FIG. 4 is a plan view of the reverse face of the connector of FIG. 1.
Figure 5:
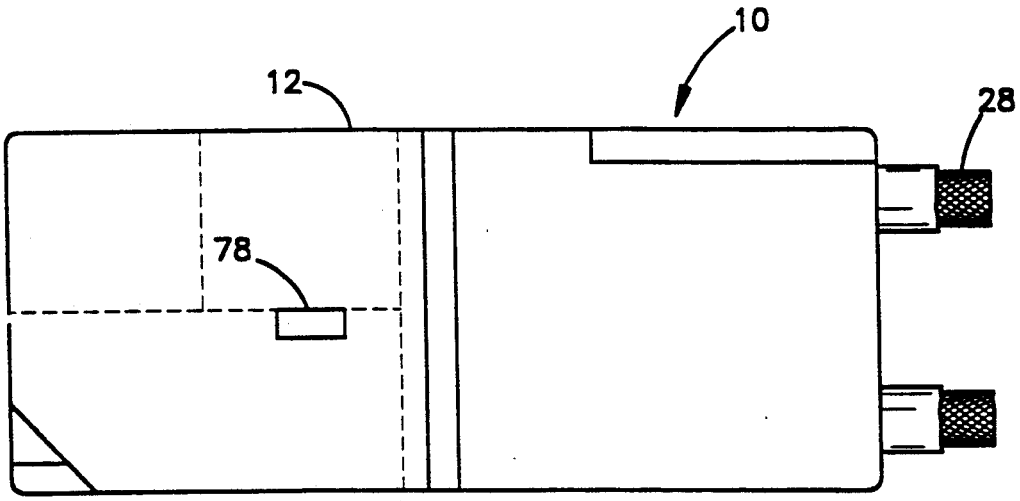
FIG. 5 is a bottom view of the connector of FIG. 1.

Referring to the drawings, the connector assembly of the present invention is indicated generally at 10 as having a body or casing 12 with a plurality of channels in a first layer or level denoted by reference numerals 14, 16, 18 formed therein in spaced parallel arrangement. Each of the channels 14, 16, 18 has a portion thereof closed by a web extending thereacross as indicated by the reference numerals 20, 22, 24.

Each of the channels 14, 16, 18 has disposed therein an electrical conductor denoted respectively by the reference numerals 26, 28, 30 is disposed or received in each of the channels 14, 16, 18 and extend externally thereof in the longitudinal direction of the channels to form a part of a wiring cable or harness (not shown). Each of the conductors 26, 28, 30 typically has a coating of plastic insulation 27, 29, 31 has respectively attached to the end thereof an individual electrical terminal which is preferably crimped thereover as denoted by the reference numerals 32, 34, 36., Each of the electrical terminals has a hooked portion extending longitudinally along the channel from the crimped portion thereof and under the respective web portions 20, 22, 24. The hooked portion of each terminal has a generally U-shaped configuration for receiving therein at right angles thereto a mating connector pin (not shown); and, the hooked portions are denoted respectively by reference numerals 38, 40, 42 in the drawings. Each of the channels 14, 16, 18 has an access opening formed therein at a common longitudinal station with the electrical terminals received in the channel, and the openings are denoted by reference numerals 44, 46, 48 in the drawings.

A second layer or level of channels is disposed beneath the channels 14, 16, 18; and, the channel in the second or lower level are denoted by reference numerals 50, 52 in the drawings. Individual electrical conductors are disposed or received in the channels 50, 52 and which are denoted by reference numerals 54, 56 in the drawings. The conductors 54, 56 extend along the channels 52 beyond the end terminal 38 of center conductor 14, and each has an electrical terminal crimped thereover as denoted by reference numerals 58, 60 respectively. Each of the latter mentioned electrical terminals has extending from the crimped portion thereof a hooked or generally U-shaped portion indicated respectively in the drawings by reference numerals 62, 64. Each of the electrical connectors 62, 64 extends under a cross web in the channel indicated respectively by the reference numerals 66, 68.

Access holes are provided in the bottom of a recess or well 70 formed in the connector body for permitting connection to the terminals 62, 64 and the access holes are denoted by reference numerals 72, 74.

The arrangement of the connector assembly 10 of the present invention is adapted to have each of the connector terminals, 40, 42, 44 and 62, 64 receive electrical connecting pins (not shown) therein simultaneously by insertion of a mating connector assembly conformed to interfit and be received in the well or recess 70. The connector body 12 may be provided with lugs or tabs on opposite sides thereof indicated by reference numerals 76, 78 provided on opposite sides thereof for retaining the connector upon insertion into a bulkhead or partition.

The connector assembly of the present invention thus provides a right angle cable or harness connector having the individual leads or conductors therein terminated at staggered locations in the direction of the conductors and at split levels to permit access to terminals provided on the ends of the conductors by a right angle connector. The present invention thereby permits the connector assembly to have a minimal transverse cross-section for a given number of specified conductors in the cable or harness and thus minimizes the space required on the partition or bulkhead for installation.

Although the connector assembly of the present invention has been described hereinabove with respect to the illustrated embodiments, it will be understood that the invention is capable of modification and variation and is intended as limited only by the following claims.

We claim:

1. A harness connector for a plural conductor cable comprising:

(a) casing means having a plurality of channels formed in one end thereof;

(b) at least one individual conductor received in each of said channels;

(c) a first connecting surface on said casing means having, at lest one opening therein communicating with one of said channels in a direction at right angles to the conductor therein; and, (d) a second connecting surface adjacent said first surface, said second surface having at least one opening therein communicating with another of said channels in said direction at right angles to the conductor therein, said second surface located on said casing means at a level displaced in said direction from said first surface.

2. The harness connector defined in claim 1, wherein said first and second connecting surfaces are disposed generally parallel to the direction of said cable conductor.

3. The harness connector defined in claim 1, wherein said first and said second connecting surfaces are disposed at adjacent longitudinal stations along said casing means in the direction of said cable conductors.

4. The harness connector defined in claim 1, wherein at least two of said channels are disposed in superposed relationship.

5. The harness connector defined in claim 1, wherein each of said conductors has a right angle terminal connector provided thereon, with each of said terminal connectors adapted to receive a pin therein.

6. A bi-level right angle connector for a plurality of conductors in a cable comprising:

(a) a connector body having a plurality of channels formed therein with each of said channels having an individual conductor received therein;

(b) at least two of said channels disposed in superposed relationship with the termination of one of said conductor staggered from the termination of the other conductor;

(c) a first-level connector surface having an aperture therein communicating with the termination of one of said superposed conductors;

(d) a second-level connector surface recessed in said body at a different level from said first surface and having an aperture therein communicating with another of said superposed conductors; and, (e) individual terminal means attached to the end of each of said conductors, said individual terminal means adapted to make electrical connection with a mating terminal when same is received through one of said openings.

7. The connector defined in claim 6, wherein said conductors and said channels are disposed in spaced parallel arrangement.

8. The connector defined in claim 6, wherein said first-and second-level connector surfaces are disposed at in spaced parallel relationship and said openings are formed at generally right angles to said surfaces.

9. The connector defined in claim 6, wherein said first-and second-level connector surfaces and said channels are disposed in spaced parallel relationship.

10. The connector defined in claim 6, wherein said conductors comprise a first layer of at least two conductors disposed in spaced parallel relationship and a second superposed layer of at least two conductors disposed in spaced parallel relationship.

11. The connector defined in claim 6, wherein said connector body includes retention means provided on the outer periphery thereof operable, upon insertion of said body into a bulkhead aperture, to engage said bulkhead and retain said body therein.

12. A right-angle connector for a plurality of conductors in a cable harness comprising:

(a) a connector body having at least two channels formed therein in spaced parallel arrangement;

(b) a conductor received in each of said channels, at least two of said conductors terminating at staggered stations along said channels;

(c) an electrical connector attached to the end of each conductor, said conductors each adapted for connection therewith in a direction of access generally at right angles to the longitudinal direction of said conductors; and, (d) said channels are disposed at separate levels staggered in said direction of access in said connector body.

* * * * *

UNITED STATES PATENT AND TRADEMARK OFFICE

CERTIFICATE OF CORRECTION

PATENT NO. : 5,186,660

DATED : February 16, 1993

INVENTOR(S) : Thaddeus S. Wielgos, et al.

It is certified that error appears in the above-indentified patent and that said Letters Patent is hereby corrected as shown below:

Column 3, line 46, claim 1, "lest" should read --least--

Signed and Sealed this

Twenty-third Day of May, 1995

*Attest:*

*Attesting Officer*

BRUCE LEHMAN

*Commissioner of Patents and Trademarks*